US006540345B1

(12) United States Patent
Wagner et al.

(10) Patent No.: US 6,540,345 B1
(45) Date of Patent: Apr. 1, 2003

(54) TRANSFER PRINTING PROCESS

(75) Inventors: Barbara Wagner, Mt. Pleasant, SC (US); Ming Xu, Mt. Pleasant, SC (US)

(73) Assignee: Sawgrass Systems, Inc., Mount Pleasant, SC (US)

( * ) Notice: Subject to any disclaimer, the term of this patent is extended or adjusted under 35 U.S.C. 154(b) by 0 days.

(21) Appl. No.: 10/096,785

(22) Filed: Mar. 12, 2002

(51) Int. Cl.[7] ..... B41J 2/01
(52) U.S. Cl. ..... 347/103
(58) Field of Search ..... 347/103, 102, 347/96, 101, 105; 399/266; 522/25, 31, 15, 16, 26

(56) References Cited

U.S. PATENT DOCUMENTS

| | | | | |
|---|---|---|---|---|
| 4,021,591 | A | | 5/1977 | DeVries et al. |
| 4,291,114 | A | | 9/1981 | Berggren et al. |
| 4,454,179 | A | | 6/1984 | Bennett et al. |
| 4,966,815 | A | | 10/1990 | Hare |
| 5,431,501 | A | * | 7/1995 | Hale et al. |
| 5,501,902 | A | | 3/1996 | Kronzer et al. |
| 5,560,796 | A | | 10/1996 | Yoshimura |
| 5,607,482 | A | | 3/1997 | Reiff et al. |
| 5,623,001 | A | | 4/1997 | Figov |
| 5,641,346 | A | | 6/1997 | Mantell et al. |
| 5,889,084 | A | | 3/1999 | Roth |
| 5,984,467 | A | | 11/1999 | Bodager et al. |
| 6,001,771 | A | | 12/1999 | Nakano et al. |
| 6,017,611 | A | | 1/2000 | Cheng et al. |
| 6,036,808 | A | | 3/2000 | Shaw-Klein et al. |
| 6,040,040 | A | | 3/2000 | Rainbow |
| 6,096,475 | A | | 8/2000 | Hare et al. |
| 6,114,406 | A | | 9/2000 | Caiger et al. |
| 6,139,672 | A | * | 10/2000 | Sato et al. |
| 6,145,979 | A | | 11/2000 | Caiger et al. |
| 6,200,668 | B1 | | 3/2001 | Kronzer |
| 6,228,486 | B1 | | 5/2001 | Kittle et al. |
| 6,232,361 | B1 | | 5/2001 | Laksin et al. |
| 6,248,804 | B1 | | 6/2001 | Lutz |

OTHER PUBLICATIONS

Textile Printing, 2nd Ed. Leslie W.C. Mile, ed. 1994 Society of Dyers and Colourists, Ch. 3, pp. 87–88 (Ian D. Raatee).

* cited by examiner

*Primary Examiner*—Raquel Yvette Gordon
(74) *Attorney, Agent, or Firm*—B. Craig Killough

(57) ABSTRACT

A process for printing and transferring an image from a receiver sheet having a thermally transferable film to a final substrate. Only the imaged area of the film is transferred and permanently fixed to a final substrate, while the non-imaged area is processed to have little or no affinity for the final substrate, and is not bound to the final substrate.

16 Claims, 5 Drawing Sheets

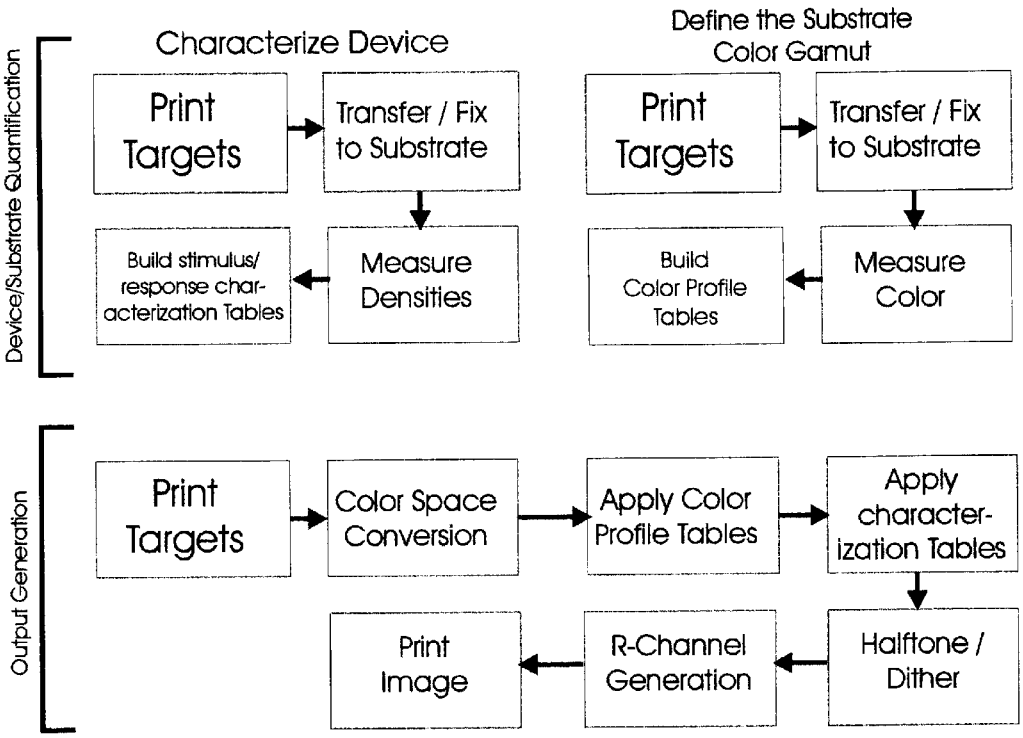
Figure 10 - Color Management Process

TRANSFER PRINTING PROCESS

FIELD OF THE INVENTION

This invention relates to printing generally, and is more specifically directed to a process of printing and transferring an image to a final substrate.

BACKGROUND OF THE INVENTION

The use of computer technology allows substantially instantaneous printing of images. For example, video cameras or scanners may be used to capture a color image on a computer. The image may then be printed onto substrates from the computer by any suitable printing means capable of printing in multiple colors, including mechanical thermal printers, ink jet printers and electrophotographic or electrostatic printers. These printing technologies are widely practiced and well understood. The methods for making full color inks and toners are also well documented. The substrates for these conventional applications, however, are limited to those that the printers can handle, invariably, smooth metal, plastic or papers of limited thickness.

Techniques are well known in the art for printing onto clothing, other textile materials, and other objects, such as wood, plastics, glass and ceramics including silk screening, digitally produced sublimation transfers, and mechanically bonded thermal transfers.

Conventional heat-melt thermal printing uses primarily non-active wax or wax-like materials such as hydrocarbon wax, carnauba wax, ester wax, paraffin wax, hot-melt resin, thermoplastic, or polymeric materials, etc. as heat-melt material. The resulting image has poor permanency since the conventional wax materials are not chemically bonded or otherwise permanently grafted to the substrate, but are temporarily and loosely bound to the final substrate by the melting of wax materials during the transfer process. The resulting image is not durable, with the wax materials being washed away during laundering of textile substrates on which the image is transferred, along with the dyes or colorants that form the image in the thermal ink layer.

The natural tendency of cotton fiber to absorb inks causes an image to lose its resolution and become distorted. Liquid inks other than sublimation inks wick, or are absorbed by, cotton or other absorbent substrates, resulting in printed designs of inferior visual quality, since the printed colors are not properly registered on the substrate. This is especially true when aqueous based ink paste is used for coating and fixing purposes as disclosed in Reiff, et al., U.S. Pat. No. 5,607,482. The substrates can be surface pre-coated or treated to improve the quality of images transferred onto substrates having a cotton component or other absorbent component with materials such as the coatings described in DeVries et al., U.S. Pat. No. 4,021,591. Application of polymer surface coating materials to the substrate allows the surface coating material to bond the ink layer to the substrate, reducing the absorbency of the ink by the cotton and improving the image quality. However, the gross surface coating on the substrate extends from the margins of the image after the image is applied to the substrate, which can be seen with the naked eye and adds hand to the fabric. Again the excess surface coating reduces the aesthetic quality of the printed image on the substrate. Further, the surface coating tends to turn yellow with age, which is undesirable on white and other light colored substrates. Yellowing is accelerated with laundering and other exposure to heat, chemicals or sunlight. A method described in Hale, et al. in U.S. Pat. No. 5,431,501 reduces the hand by printing a surface preparation material over the entire image, on the intermediate substrate, but not beyond the boundaries of the image. The image is then transferred from the medium to the final substrate by applying heat and pressure such that the surface preparation material permanently grafts the ink solids to the substrate.

Heat activated, or sublimation, transfer dye solids change to a gas at about 400° F., and have a high affinity for polyester at the activation temperature. Once the gasification bonding takes place, the ink is permanently printed and highly resistant to change or fading caused by laundry products. While sublimation dyes yield excellent results when a polyester substrate is used, these dyes have a limited affinity for other materials, such as natural fabrics like cotton and wool. Accordingly, images produced by heat activated inks comprising sublimation dyes, which are transferred onto textile materials having a cotton component, do not yield the high quality images experienced when images formed by such inks are printed onto a polyester substrate. Images which are printed using sublimation dyes applied by heat and pressure onto substrates of cotton or cotton and polyester blends yield relatively poor results.

Thermal transfer sheets are known in the art and are designed for printing by various printing mechanisms. With these thermal transfer sheets, the entire sheet is transferred to the final substrate: the imaged area as well as the non-imaged area. The thus transferred material can be seen and felt in the non-imaged area. In addition, laundering and normal wear will cause the transfer material to yellow. This yellowing is obvious in the non-imaged areas, particularly against a white background, such as a t-shirt. In addition to yellowing, redeposition of colorant is often seen in the non-imaged area of the transfer film after laundering. Most commercially available heat transfer paper suppliers recommend cutting away the unprinted area of the paper prior to heat transfer. This is especially tedious and impractical when the image contains text or other fine details that must be cut around.

Transfer papers with good receptivity for images printed with wax-based inks and crayons have been disclosed. For example, a basesheet may be coated with a layer of Singapore Dammar resin for good wax-based ink receptivity.

Kronzer, U.S. Pat. No. 6,200,668 describes a transfer sheet for inkjet printing. A multi-layered sheet is formed with a basesheet of film or cellulosic nonwoven web, followed by various laminating layers. After an image is printed onto the sheet, the image-bearing laminating layers are transferred by the application of heat and pressure to the backside of the basesheet. The basesheet is desirably split from the laminating layers after the basesheet has cooled.

Bodager, et al., U.S. Pat. No. 5,984,467 describe an inkjet media composed of various layers including an ink-receiving layer, which may be transferred as a laminate to a final substrate. The ink receiving laminate is composed of about 80% adhesive, such as polyester resins, polyvinyl alcohol homopolymers and copolymers, polyvinylpyrolidone, and blends, copolymers of vinyl acetate with ethylene and/or vinyl chloride; and thermoplastic polymer and/or reactive components. Water from the inkjet ink is absorbed into an underlying water-absorbing layer composed of a hydrophilic polymer. During the lamination step the water-absorbing layer is split from the ink-receiving layer.

In the case of heat transfer sheets to be imaged by laser printers or color copiers, for example, the transfer material must have a melt point higher than the fuser rollers within the copier or printer. An image-receptive layer may be comprised of a thermoplastic polymer selected from a group comprising polyolefins, polyesters, and ethylene-vinyl acetate copolymers which melt above 100° C.

There are a large number of patents related to thermal transfer sheets. These are distinguished from the current invention in that they generally refer to color, wax-based ink ribbon technology, and the transfer of this ink from the ribbon to a substrate via a thermal print head of elevated temperature contacting with the backside of the ribbon to melt and release the ink layer.

The use of radiation curing technology has been used in combination with transfer sheets. For example, Berqqren, et al., U.S. Pat. No. 4,291,114, produce an image by exposing a colored, photopolymerizable material of a transfer sheet to activating radiation in an image-wise manner. The image is then transferred to a substrate by the application of pressure to the backside of the transfer sheet. Bennett, et al., in U.S. Pat. No. 4,454,179 employ a radiation cure adhesive on a transfer sheet. A transparent carrier film is coated with an ink layer via conventional means, such as screen-printing. Conventional coating or laminating techniques cover the carrier film with an ink layer and then apply a radiation cured adhesive layer. After drying the adhesive layer, a release liner is applied for protective purposes. The transfer sheet is then exposed to actinic radiation through the transparent carrier film, thus curing the adhesive in the non-inked areas. The release liner is then removed and the transfer sheet is positioned on a substrate, and pressure is applied across the carrier film. The carrier film is then removed, taking the exposed adhesive with it, and leaving the ink, and underlying unexposed adhesive, bonded to the substrate.

In application Ser. No. 09/670,674 a method of transfer printing by digitally printing onto a radiation curable coated media, followed by exposing the printed media to actinic radiation, is disclosed. The exposed, non-imaged area is effectively cured and rendered non-transferable, while the image area and underlying unexposed coating are transferred to a final substrate.

Radiation curable inks are well known in the art. For example, the screen-printed inks employed in Bennett may be UV curable. Of particular interest to the present invention are radiation curable inkjet inks. Examples of such are disclosed in Caiger, eta al., U.S. Pat. No. 6,114,406, Roth, U.S. Pat. No. 5,889,084, Mantell, et al., U.S. Pat. No. 5,641,346 and Figov, U.S. Pat. No. 5,623,001, and are incorporated herein by reference.

SUMMARY OF THE INVENTION

The present invention is a process for printing and transferring an image to a final substrate. In this invention, only the imaged area is transferred and permanently fixed to a final substrate, while the non-imaged area is processed to have little or no affinity for the final substrate, and is not bound to the final substrate.

A receiver sheet comprises a thermally transferable film. The receiver sheet is imaged, such as by printing the film with any ink or toner. The receiver sheet is either separately or simultaneously applied with a radiation curable material in the non-imaged area. As a result, part of the film is covered by the image, and the remainder is covered with the radiation curable material that is printed or applied in the non-imaged area. After printing, the radiation curable material is cured by exposing the sheet to a radiation source.

The sheet is then placed in contact with a final substrate, such as a t-shirt, with the ink side in contact with the substrate, and energy (e.g., heat) is applied to the back of the receiver sheet to transfer the film. The portion of the film that has an image thereon is transferred to the final substrate and is mechanically and/or chemically adhered to the final substrate. The cured radiation curable portion of the film renders the non-imaged area of the film non-tacky and non-adhesive, so that it is easily removed from the substrate.

BRIEF DESCRIPTION OF DRAWINGS

FIG. 10 is a flow chart demonstrating color management as applied to the printing process.

DESCRIPTION OF THE PREFERRED EMBODIMENTS

Figure 1:
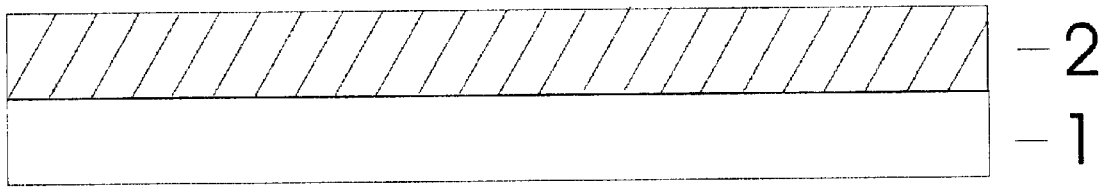
FIG. 1 depicts a transfer sheet.

A heat transfer material is prepared, coated on a base sheet (1) and dried, if necessary, to form a heat transfer film (2), as shown in FIG. 1. The heat transfer film (2) may be composed of several layers. Alternatively, any commercially available heat transfer sheet may be used, such as Hanes Easy-Peel™ Transfer Paper, Xerox Color Inkjet Iron-on Transfers and Canon TR-101 T-shirt Transfers for inkjet images, and Wyndstone Image-Select® Heat Transfer Paper for color laser copier/printer images. When referring to areas printed with an ink other than the radiation curable material, the terms "imaged", "image-wise", "image", etc. will be used. Traditionally, an ink is described as a colored liquid used for printing. The term "ink" is used herein to describe a printable or image forming substance, liquid or solid, including toner. The ink herein is usually colored, but it may be absent of color. "Non-imaged" means areas of the substrate that do not have a part of the image thereon, and are to be printed or covered with the radiation curable material, which may be ink that is radiation curable ("radiation curable ink") of the present invention.

Figure 2:
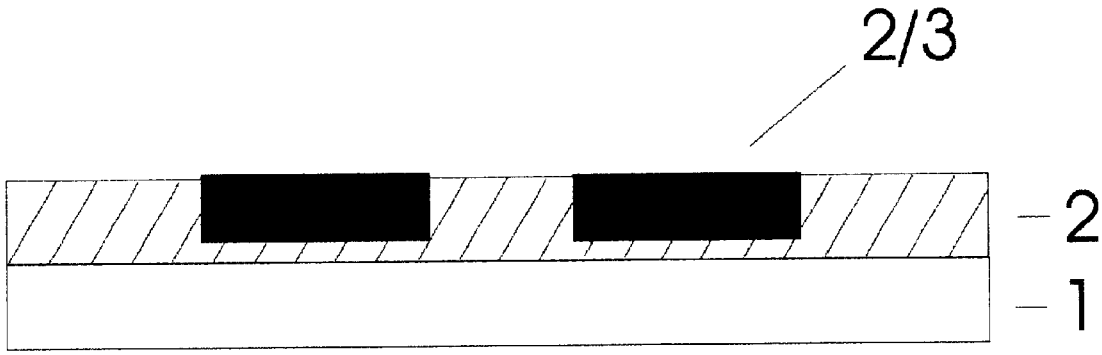
FIG. 2 depicts an imaged transfer sheet according to the invention.
Figure 3:
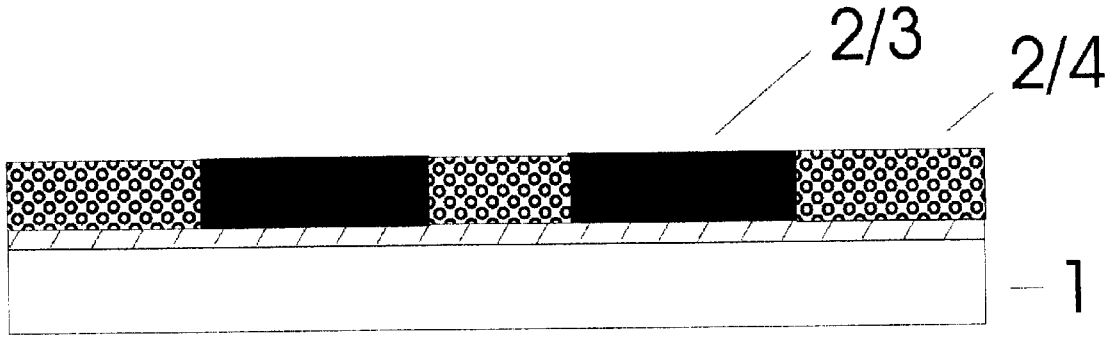
FIG. 3 depicts an imaged transfer sheet printed in the non-imaged area with a radiation curable ink according to the invention.

The heat transfer receiver sheet is printed image-wise with an ink (3), as shown in FIG. 2. The non-imaged area is printed with a radiation curable ink (4), as shown in FIG. 3. The radiation curable ink (4) may be printed from the same printer as the ink (3), or from a separate printer.

As an example of printing both the image with ink and the non-imaged area with a radiation curable ink simultaneously, an inkjet printer may be supplied with five cartridges. Four of the cartridges may contain cyan, magenta, yellow and black ink, while a fifth contains the radiation curable ink. Another example is a laser printer supplied with four cartridges containing cyan, magenta, yellow and radiation curable toners. The radiation curable ink may be printed prior to, simultaneously with, or subsequent to the ink image.

Figure 4:
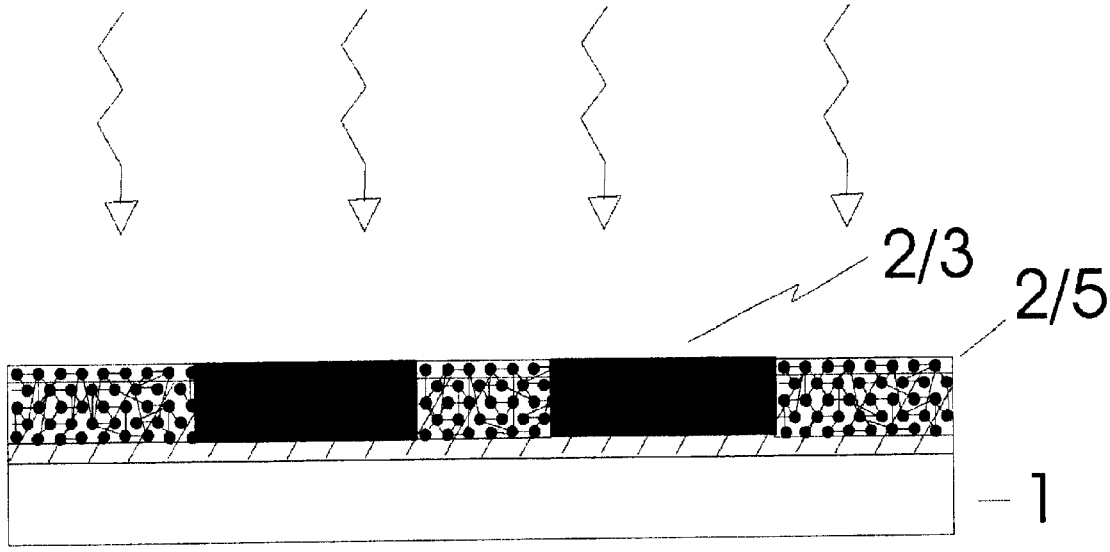
FIG. 4 depicts a radiation cured transfer sheet according to the invention.
Figure 5:
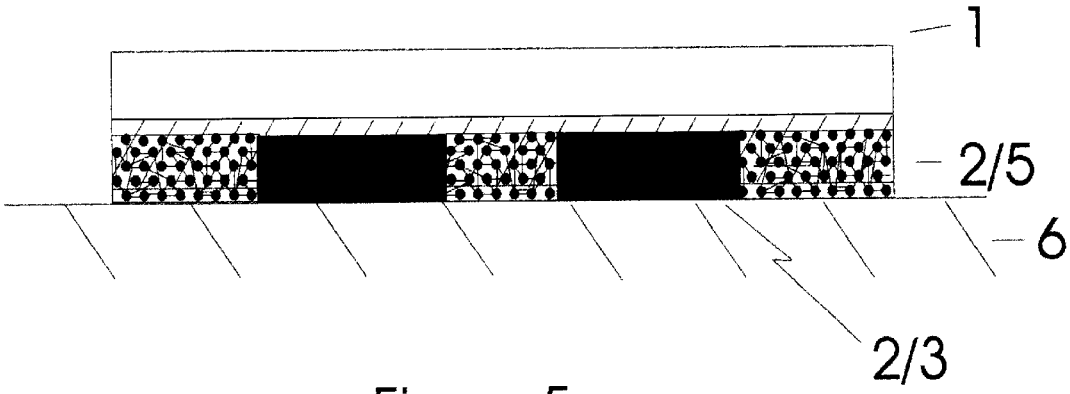
FIG. 5 depicts a printed, radiation cured transfer sheet invented from FIG. 4 with the image in contact with a final substrate.

After printing both the image and non-imaged area, the transfer article is exposed to activating radiation to cure the radiation curable ink that is present on the non-imaged area of the receiver sheet (5), as shown in FIG. 4. Alternatively, if the non-imaged area is first printed, the article may be cured prior to printing the image. Once cured, the radiation curable ink becomes a hard, smooth non-adhesive film. The printed image is transferred to a final substrate by the application of energy, i.e. heat with or without pressure, to the backside of the receiver sheet. The non-imaged areas of the original transfer film that have been printed with radiation curable ink and cured provide a barrier between the transfer film ingredients and the final substrate. FIG. 5 illustrates the imaged article after radiation cure of the non-imaged area and placement in contact with the final substrate (6), prior to transfer of the image. After application of energy to the backside of the imaged article, the image (3) and overlying heat transfer film (2) reside on the final substrate (6) (FIG. 6), while the cured, non-imaged area (5) and underlying heat transfer film remain on the base sheet (1). Upon application of heat to the backside of the imaged article, the transfer film begins to soften and/or melt. Areas that have been printed with radiation cured ink are non-tacky on the cured surface in contact with the final substrate and therefore have no affinity for the final substrate, while areas printed with the desired image on the transfer film will become tacky and adhere to the final substrate.

There are a number of adhesive forces involved in the transfer process. In a simplified example, with no image to be transferred, FIG. 7 illustrates a force F1 between the base sheet (1) and the transfer material (2), a force F2 between the transfer material (2) and the substrate to which it is being transferred (6), and a force F3 within the transfer material (2), also known as a cohesive force.

Figure 7:
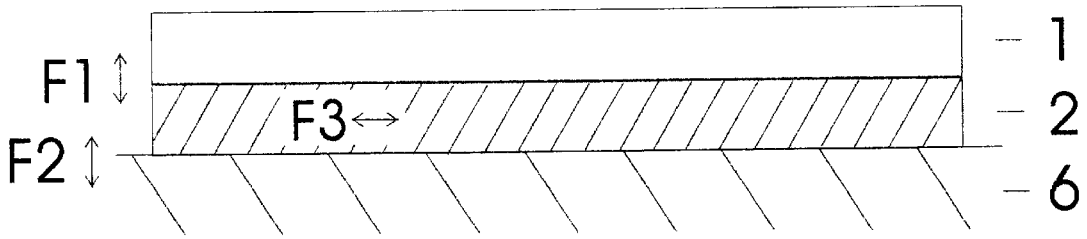
FIG. 7 depicts a transfer sheet in contact with a final substrate illustrating cohesive and adhesive forces.

In FIG. 7, during heat transfer, the manner in which the base sheet (1) in contact with the final substrate (6) is split is dependent on the magnitude of the various forces. For example, if forces F1 and F2 are significant and the temperature is above the softening point of the transfer material (2), the transfer material may split, leaving part of the image on the base sheet and part on the substrate. Ideally, during the transfer process, force F2 between the transfer material and substrate, and cohesive force F3 are strong, while force F1, between the transfer material and the base sheet is relatively weak. In this case, the transfer material will be transferred to the substrate intact.

Figure 8:
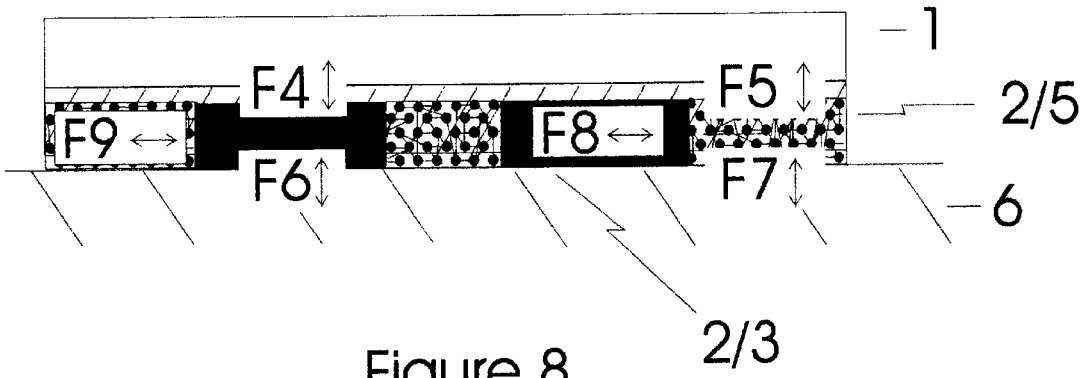
FIG. 8 depicts a printed, radiation cured transfer sheet in contact with a final substrate, illustrating various adhesive and cohesive forces.

As another example, FIG. 8 illustrates adhesive forces for a printed transfer sheet of the invention in contact with the final substrate to be imaged. There is a force F4 between the basesheet (1) and the printed imaged transfer material (2/3), a force F5 between the basesheet (1) and the radiation cured non-imaged transfer material (2/5); a force F6 between the printed imaged transfer material (2/3) and the substrate to which the image is to be transferred (6); a force F7 between the radiation cured non-imaged transfer material (2/5) and the substrate (6); a cohesive force F8 within the printed imaged transfer material (2/3), and a cohesive force F9 within the radiation cured non-imaged transfer material (2/5).

Figure 6:
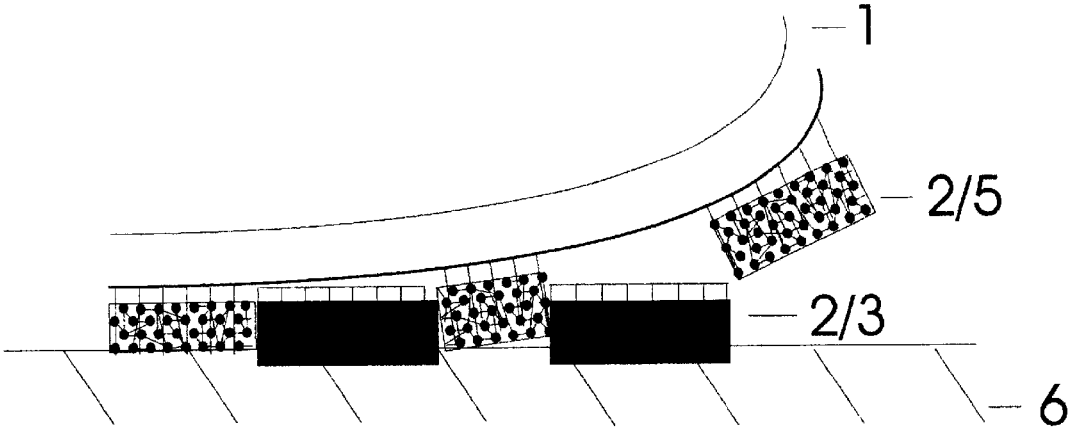
FIG. 6 depicts a printed, radiation cured transfer of the image to the final substrate.
Figure 9:
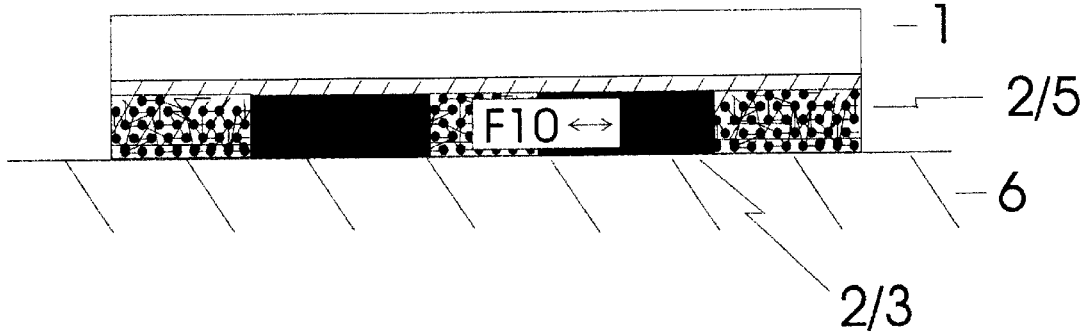
FIG. 9 depicts a printed, radiation cured transfer sheet in contact with a final substrate, illustrating an adhesive force between the imaged and non-imaged areas.

An additional force exists between the printed imaged transfer material (2/3) and the radiation cured non-imaged transfer material (2/5), F10 in FIG. 9. During the heat transfer process, energy is applied to the backside of the base sheet. After applying energy to the base sheet, the base sheet is peeled away from the substrate carrying with it the radiation cured, non-imaged material, as illustrated in FIG. 6. This selective removal of the radiation cured, non-imaged area requires cleavage of the transfer material at the image boundary, between the radiation cured, non-imaged area and the imaged transfer material. In general, force F7 is less than F5 and F6, and F4 is less than F6 (FIG. 8). In some cases, after applying heat to the backside of the base sheet, forces F5 and F7, shown in FIG. 8, may be approximately equal. The radiation cured, non-imaged area, 2/5, will have no affinity for the final substrate, 6, or the base sheet, 1. In this case, the radiation cured, non-imaged material, 2/5, may be easily removed from the final substrate.

In actuality, there may be a number of additional forces involved, such as with heat transfer sheets composed of multiple layers. Each layer will have some magnitude of adhesion to its adjoining layers. There may also be forces between the printed ink and the material to which is it printed, as might be the case with a wax-based ink printed onto transfer material. In some cases, the printed ink is either absorbed into the transfer material, as might be the case with an inkjet ink, or fused or melted into the transfer material during printing.

The base sheet (1) may be any supportive material that is formable into a sheet. Examples include, but are not limited to, films of polyester, such as polyethylene terephthalate, cellulose acetate, polystyrene, polyamide, polycarbonate, polystyrene, polyurethane, polyimide, triacetate, polyethylene, polypropylene, aramide, and polyvinyl chloride. These materials may form a coating on paper. Other examples include cellophane, glassine paper, paper made of natural cellulosic fiber materials, copy, inkjet or laser paper, polyethylene-clad paper, opaque filled paper, condenser paper, metalized paper, and metal. These films and/or papers may be coated with a release material such as silicone, cellulose ethers, acrylic, fluorocarbon resin, such as polytetrafluoroethylene, and polyolefin. The thickness of the base sheet is preferably between 50–150 microns.

The heat transfer film (2) may be one or more layers coated onto the base sheet (1). The heat transfer film layer or layers may be applied via any method known in the art, such as extrusion coating, rod coating, gravure coating, curtain coating, air-knife coating, blade coating, dip coating, spray coating, printing and the like. Heat transfer films will generally consist of thermoplastic polymers in a film-forming binder. Other ingredients may include cross-linking agents, humectants, rheology modifiers, waxes, antiblocking agents, antioxidants, plasticizers, pigments, fillers, mordants, UV absorbers, surfactants and optical brighteners.

Useful thermoplastic polymers soften or melt at elevated temperatures and may crosslink at elevated temperatures (i.e., 100–180° C.), and resolidify when cooled. Examples of thermoplastic polymers are polyolefins, such as polyethylene and polypropylene, polyesters, cellulose esters, ethylene-vinyl acetate copolymers, ethylene-acrylic acid copolymers, polyvinyl alcohol, polyvinyl acetal, poly(meth) acrylates, poly(meth )acrylic acid, polyacrylic acid derivatives, polyether, polyacrylamides, polyamides, polyimides, polystyrene, polycarbonate, polysulfone, polyvinyl chloride, polyurethane, waxes, epoxy polymers, and copolymers thereof. Crosslinking polymers may be included to improve adhesion of the printed heat transfer film to the final substrate, such as fabric. "Crosslink" means that the polymer has a reactive group that forms a physical or chemical bond. Examples include isocyanates, epoxides, melamine formaldehydes, polyfunctional aziridines, carbodiim ides, acrylam ides, polyamides, polyam ines, and the like.

A binder or combination of binders is added to the materials of the heat transfer film for the purpose of binding the particles of thermoplastic polymer together, and to help in the binding of the imaged heat transfer film to the final substrate, such as fabric. Examples of film-forming binders include resins of the thermoplastic polymers described above, polyvinyl pyrrolidone, cellulose ethers and their derivatives, gelatin, casein, albumin, chitin, chitosan, pectin, dextran, collagen derivatives, xanthum, sulfonated polystyrene, and carboxylated styrene butadiene polymers.

When inkjet printing devices are used, an inkjet printable layer may be formed on top of the thermoplastic polymer/binder layer as part of the heat transferable film, or the layer may comprise the entire heat transfer film. The inkjet printable layer is composed of thermoplastic polymers and film-forming binders. The thermoplastic polymers are generally limited to those that are water-insoluble.

The ratio of thermoplastic polymer to binder is in the range of 1:2 to 50:1, and preferably, in the range of 1:2 to 20:1. The heat transfer film is generally 2 to 100 microns thick, and preferably 5 to 50 microns thick, and will melt at 65° C. to 200°, and preferably in the range of 80° to 150° C.

The imaging inks and methods used to print an image on the heat transfer sheet may be any known ink and printing method, including digitally printed inks and corresponding printers, such as aqueous or solvent-based inkjet inks, phase-change or hot melt inks, wax thermal inks and toners, xerographically printed toners, such as from copiers, or conventionally printed inks and corresponding methods, such as screen-printed inks, relief, planographic and intaglio inks and printing, or combinations of digital and conventional inks and printing methods. Preferably the inks will be digitally printed, most preferably inkjet inks printed with an inkjet printer. The inks forming the image will usually contain colorants. The colorants may be pigments or dyes, or combinations thereof. Suitable colorants include, but are not limited to, pigments, reactive dyes, direct dyes, vat dyes, sulfur dyes, acid dyes, solvent dyes, disperse dyes and basic dyes. In addition, the inks will contain a vehicle, such as solvent or water, wax or resin. Other additives may be present such as emulsifying enforcing agents, dispersants, surfactants, antioxidants, humectants, biocides, penetrants, charge control agents, and crosslinkable ingredients, such as isocyanates, epoxides, polyols, and the like.

A radiation curable ink (i.e., 4 in FIG. 3) is used to print over the entire non-imaged area. No radiation blocking materials will be added to the radiation curable ink. Usually, no colorant in the form of a pigment or dye is added to the radiation curable ink.

The radiation curable ink will be printed on the heat transfer sheet by any known type of ink and method preferably by digital means such as aqueous or solvent-based inkjet inks, phase-change or hot melt inks, wax thermal inks and toners, and the corresponding printing methods, or it may be printed xerographically, such as with a copier.

The radiation curable ink ingredients may include, but are not limited to, one or more photoinitiators, monomers and/or oligomers or prepolymers, and other additives. For the preferred embodiment of an inkjet radiation curable ink, the monomeric or oligomeric base vehicle will have a low viscosity and is preferably substantially free of solvent. A radiation curable inkjet ink formulation will have a viscosity in the range of 1 to 100 cps, preferably between 1 and 50 cps.

Examples of suitable monomers and/or oligomers or prepolymers for use in inkjet inks include those disclosed in Mantell, et al., U.S. Pat. No. 5,641,346, Roth, U.S. Pat. No. 5,889,084, Caiger, 6,114,406, and Lutz, 6,248,804. Additional examples of monomers and/or oligomers or prepolymers are, but are not limited to, epoxies, such as butadiene oxide, propylene oxide, diglycidyl ether of bisphenol A, 3,4-epoxycyclohexanecarboxylate, epoxy silicones, glycidol, octylene oxide, oxetane, phenyl glycidyl ether, polyglycidyl ether of novolak resin or phenolformaldehyde resole, propylene oxide, styrene oxide and vinylcyclohexene oxide; vinyl ethers, such as butanediol monovinyl ether, butyl vinyl ether, cyclohexane dimethanol monovinyl ether, cyclohexyl vinyl ether, diethyleneglycol divinyl ether, dodecyl vinyl ether, ethylene glycol monovinyl ether, 2-ethylhexyl vinyl ether, ethyl vinyl ether, octadecyl vinyl ether, poly-THF divinyl ether, propenyl ether of propylene carbonate, propyl vinyl ether and triethylene glycol methyl vinyl ether; cyclic ethers and thioethers, such as butylene oxides, pentylene oxides, thiopropylenes and 1,3,5-trioxanes; unsaturated polyesters formed from di- or polyfunctional carboxylic acid (or their anhydrides), such as adipic acid, citraconic anhydride, cyclohexane dicarboxylic acid, dimeric methacrylic acid, fumaric acid, glutaric acid, maleic anhydride, malonic acid, orthophthalic acid, succinic acid, terephthalic acid, tetrahydrophthalic anhydride and trimellitic acid; and di- or polyhydric alcohols, such as bisphenol A, butanediol, diethylene glycol, dipropylene glycol, dodecanediol, ethylene glycol, hexanediol, neopentyl glycol, pentaerythritol, propanediol, triethylene glycol and trimethylol propane; polymers having acrylate or methacrylate groups, such as dimethacrylate terminated urethanes, triacrylates, such as trimethylolpropane triacrylate, diacrylates, such as 1,6-hexanediol diacrylate, acrylic acids, methacrylic acids, epoxy acrylates and epoxy methacrylates, phenoxyethyl methacrylate and tetrahydrofurfuryl acrylate, or any combination of the above.

The ink formulation may include one or more photoinitiators. Examples of such include, but are not limited to, ferrocinium-types, such as $\eta^5$-2,4-(cyclopentadienyl) {(1,2,3,4,5,6-η-)-(methyleth)-benzene}-iron (II); indonium salts, such as bis-(dodecylphenyl)-indonium hexafluoroantimonate mixture of isomers; sulfonium-types, such as mixed triarylsulfonium hexafluoroantimonate salt and mixed triarylsulfonium hexafluorophosphate salt; benzoin; benzoin ethers, such as benzoin ethyl ether and benzoin isopropyl ether; benzyl ketals, such as benzyl dimethyl ketal; acyl phosphines, such as diphenyl-(2,4,6-trimethyl benzoyl) phosphine oxide; aryl ketones, such as 1-hydroxy cyclohexyl phenyl ketone (HCPK); bis($\gamma^5$-cyclopentadienyl)bis [2,6-difluoro-3-(1H-pyrr-1-yl)phenyl]-titanium; 2-methyl-1-[4-(methylthio)phenyl]-2-morpholino-propan-1-one; 3,6-bis(2-methyl-2-morpholino-propanonyl)-9-butyl-carbazole; benzophenone, methyl 2-benzoylbenzoate; 2,4,6-trimethylbenzoyl-diphenyl-phosphine oxide; 4,4'-bis (dimethylamino)-benzophenone (Michler's ketone); benzil, ethyl 4-(dimethylamino)benzoate; 1-(4-dimethylaminophenyl)-ethanone; unsaturated amine acrylates and unsaturated copolymerizable tertiary amines, quinones, such as 9,10-anthraquinone; photosensitizers, such as cumene hydroperoxide, anthracene and thioxanthone derivatives. The amount of photoinitiator may be from 0.1 to 20 wt. % of the ink; preferably 0.1 to 10 wt. %. The photoinitiator used may be kept separate from the other ingredients of the radiation curable ink until it is printed. It may be printed from a separate cartridge, for example, or it may be incorporated in the preparation of the heat transfer film. The photoinitiator may be printed before, during, or after the monomer/oligomer vehicle, or ink image.

The radiation curable ink may optionally contain other additives such as surfactants, photoinitiator stabilizers, wetting agents, defoamers, plasticizers, and/or solvents, such as water or low molecular weight alcohols.

Color Management

A process of color management is preferred to be applied during the reproduction of the output when using a digital printer, so that the apparent color of a digital image on any of the final substrates will match the color of the original image as it was created. The color management process defines a method of converting the color values of a digital image from an input color space ($CS_i$) to the corresponding color values of a substrate color space ($CS_s$) while maintaining the visual color components. This process may be unique for each combination of printer, final substrate, ink set, curing and transfer devices, and/or media.

Color correction and color management may be accomplished by the process shown in FIG. 10, as applied to the printing process of the invention. This process is further described below.

Characterize the Output Device

Device characterization ensures that the density of the image on the target substrate matches the density requested by the print application. For example, if the print application requests a 22% density square of black, a properly characterized device will produce output that will transfer to a black square of 22% density on the target substrate. If the device is not properly characterized, the final substrate will not accurately reproduce the target colors. For printed output, device characterization is accomplished by measuring the density of the printed output against a known target value. For the transfer process, device characterization must be extended to include the combination of device, ink set, heat transfer film, and final substrate.

In order to characterize a device, ink, transfer film and final substrate combination, a table of input (stimulus) and adjustment (response) data pairs is built. This table represents the channel output values that need to be sent to the printer in order to reproduce the density on the output substrate that matches the density of the input value.

The substrate characterization process includes the combination of devices and materials associated with transfer or fixing of the image onto various final substrates. Considerations of parameters being used by these devices can also be critical to the quality of the image reproduction. Only the characterization of each combination of digital input/output devices, transfer/fixing devices, transfer mediums, and final substrates can ensure the required quality of the final product. Temperature, pressure, time, media type, moisture level, second degree dot size change and color degradation, interrelation between inks with the media and final substrate, etc. are examples of such parameters.

The characterization table is built by sending a set of data points (stimuli) to each color channel of the printing device. The data points represent a gradation of percentage values to be printed on each of the print device's color channels (from 0 to 100%). To make this process accurately reflect the final output, considerations must be given to potential application of transfer film and transfer or fixation process to a final substrate before the response measurements are taken. Using a densitometer, the densities of each color channel on the transferred output are read from the substrate. The maximum density is recorded, and a linear density scale is computed using the same percentage increments as the stimuli gradation scale. The corresponding densities from each scale are compared. For each step of the gradation, a response value is calculated. The response value is the percentage adjustment, negative or positive, that the stimulus value will be adjusted by so that the target output density will match the stimulus density. These stimulus/response data points are entered into the characterization table.

The stimulus/response tables are built through repeated iterations of creating the target density squares on the substrate, measuring the density, and adjusting the associated response value. A stimulus response table must be built for each color channel of the output device.

Define the Color Substrate Gamut

The process of creating digital output on a printing device and transfer/fixing the output onto a final substrate can reproduce only a finite number of colors. The total range of colors that can be reproduced on any final substrate is defined as the substrate color gamut. The substrate color gamut will vary for every combination of output device, transfer temperature, transfer pressure, transfer time, transfer medium type, substrate moisture level, and final substrate. The process of defining the total range of colors that can be reproduced on an output substrate is called substrate profiling.

Profiling a non-transferred color gamut is accomplished by printing a known set of colors to a print media, measuring the color properties of the output, and building a set of stimulus/response data points. To accurately define the substrate color gamut, substrate profiling must be performed after the digital image is output to the transfer media and transferred onto a final, or target, substrate.

To quantify the substrate gamut, a computer application capable of treating colors using a device independent color space (typically the CIE XYZ or L*a*b color spaces) is used to generate a representative set of color squares. These color squares are modified by adjusting the density values of each color channel according the data in the characterization table, outputting to the printing device, and transferring to the target substrate.

A color target consisting of a set of CIE based color squares is used to measure the output gamut. The color target is converted into the print device's color space (i.e. RGB into CMYK), each channel has the percent values adjusted by the response value stored in the characterization table, sent to the output device, and transferred to the target substrate. The calorimetric properties of the color squares are measured using a calorimeter and stored as a set of stimulus/response data pairs in a color profile table. This table is the data source used by software algorithms that will adjust the requested color of a digital image so that the image, when viewed on the target substrate, has the same calorimetric properties as the original image.

A color profile table is created for each combination of output device, transfer temperature, transfer pressure, transfer time, transfer medium type, and final substrate that will be used to transfer the digital image onto the final substrate.

Rasterization and Output of the Digital Image

If the original digital image is not in the same color space as the output device, for example an RGB image is output to a CMY device, the image is converted into the color space required by the output device. If the output device requires a black color channel, the K component (black) is computed by substituting equal amounts of the CMY with a percentage of the black color channel.

For each digitized picture element, or pixel, in the image, the color value is modified. The new value is equal to the response value stored in the color profile table when the pixel's original color value is used as a stimulus. The percentage values of each of the pixel's color channels are adjusted by the amount returned from the characterization table when the pixel's color modified percentage value is used as stimulus.

The CMYK digital image is halftoned using methods described in "Digital Halftoning". The CMYK image pixels are converted into device pixels according to standard algorithms.

The present process requires an additional channel, R (radiation-curable), for application of the radiation curable ink in the non-imaged area on the transfer layer. The R channel is computed by reading the color value for each device pixel location (referred to as the source device pixel) in each of the halftoned, gamut-corrected color channels, C, M, Y, and K. If there is color data in any of the C, M, Y, or K color channels at the corresponding source device pixel location, the corresponding device pixel of the R channel (referred to as the target device pixel) is set to 0. If there is no color data in any of the C, M, Y, or K color channels at the source device pixel location, the target device pixel and it's surrounding device pixels become candidates for R channel data. For a target device pixel in the R channel to be set on, the surrounding source device pixels are analyzed to see if any adjacent device pixels have CMYK data. The number of adjacent device pixels to be searched can be varied and is referred to as the source search area. If none of the device pixels in the source search area have C, M, Y, or K data, R channel data will be created. All of the device pixels that correspond to the source search area will be set on.

Following printing of the radiation curable ink in the non-imaged area, the media is exposed to radiation according to the invention. The term "radiation" means the transfer of energy from a transmitting source to an absorbing object without interaction with any intervening matter. Ultraviolet (UV) radiation having a wavelength of 100 to 3700 Å may be used. Ultraviolet (UV) radiation having a wavelength of 100 to 3700 Å may be used. UV radiation is sufficiently energetic to initiate the curing chemical process when a suitable photoinitiator is present. An advantage of using UV radiation is that these wavelengths are not present in an appreciable amount in background visible radiation. An electron beam can also be used to induce reactions of monomers, oligomers and polymers. These electrons provide sufficient energy so that photoinitiators are not necessary. On the other hand, they are so energetic that the penetration of electrons is much greater than that of photons. For the purposes of this invention, "radiation", "UV" or "ultraviolet" radiation will be used to denote a method used to initiate polymerization, and includes electron beam and ultraviolet radiation.

A number of light sources are available for the UV curing process. Examples include medium pressure mercury lamps, low pressure mercury lamps, iron doped mercury lamps, gallium doped mercury vapor lamps, electrodeless lamps, xenon lamps, argon ion lasers and excimer lasers. The most common source is the medium pressure mercury lamp, which provides extremely intense output for fast cure times and relatively low energy a consumption. Typical cure times range from 1 millisecond to 10 seconds. The most basic mercury bulb emits energy in both short and long wavelength ranges, but is stronger in the shorter wavelengths. Short wavelengths work on the surface, while longer wavelengths work more deeply in a coating. Electron beam generators are generally either a scanned beam or linear cathode type. Generally, dosages are from less than 1 megarad to 100 megarad.

Ideally, the UV curing system will be integrated with the device that applies the image and/or the radiation curable ink, such as the printer. This is not a requirement, however, and the printed radiation curable media may be cured at a later time and/or location.

Following radiation curing of the radiation curable ink, the image is ready to transfer to a final substrate. The image may be immediately and permanently transferred onto a final substrate, or the image may be transferred from the transfer sheet to the final substrate at a later time. The final substrate may be any substrate that can withstand the transfer conditions. Examples of substrates include, but are not limited to, textile substrates, such fabrics or finished garments, or onto other substrates, such as metal, ceramic, wood, or plastic. A wide selection of preferred final substrates is possible, including, but not limited to, textiles, and especially natural, semi-synthetic or synthetic materials. Examples of natural textile materials include wool, silk, hair and cellulosic materials, particularly cotton, jute, hemp, flax and linen. Examples of synthetic and semi-synthetic materials include polyamides, polyesters, polyacrylonitriles and polyurethanes. Textile materials may be a blend of natural and synthetic fibers, as well.

Heat transfer to the final substrate is accomplished by any means known in the art. A commercial heat press, such as the Geo Knight Digital Swingaway Press, Hix HT-400 Press, or Astechnologies Astex 1600, or a hand iron are typically used. The temperature at which the image is transferred to the final substrate is about 100° C. to 200° C., preferably 110° C. to 180° C. The temperature will vary depending upon the materials used in the transfer film layer. When a commercial heat transfer paper is used, such as those cited above, manufacturer's instructions should be followed. The heat transfer process may include the application of pressure, for example 10–40 psi pressure.

What is claimed is:

1. A radiation curable transfer process comprising the steps of a. supplying a heat transferable receiver sheet;

b. forming an image on a portion of said heat transferable receiver sheet;

c. applying a radiation curable material over a portion of said heat transferable receiver sheet where said image is not present;

d. applying radiation to said radiation curable material to cure said radiation curable material; and e. subsequently applying heat to said heat transferable receiver sheet and transferring said portion of said heat transferable receiver sheet where said image is present and binding said portion of said heat transferable receiver sheet where said image is present to said final substrate, wherein said portion of said heat transferable receiver sheet where said image is not present is not bound to said final substrate.

2. A radiation curable transfer process according to claim 1, wherein said image is formed by a digital printer and said radiation curable material is applied by said digital printer.

3. A radiation curable transfer process according to claim 2, wherein said radiation curable material is cured by exposure to ultraviolet radiation.

4. A radiation curable transfer process according to claim 2, wherein said radiation curable material is cured by exposure to ultraviolet radiation having a wavelength in the range of 200–400 nm.

5. A radiation curable transfer process according to claim 2, wherein said digital printer is directed by computer software, and said computer software detects a position of said image on said heat transferable receiver sheet, and if said computer software determines that said image is not present on an point of said heat transferable receiver sheet that is greater than a predetermined distance from said image, then said software directs said digital printer to apply said radiation curable material to said area of said heat transferable receiver sheet that is greater than said predetermined distance from said image.

6. A radiation curable transfer process according to claim 5, wherein said radiation curable material is cured by exposure to ultraviolet radiation.

7. A radiation curable transfer process according to claim 5, wherein said radiation curable material is cured by exposure to ultraviolet radiation having a wavelength in the range of 200–400 nm.

8. A radiation curable transfer process according to claim 1, wherein said radiation curable material does not comprise a colorant.

9. A radiation curable transfer process according to claim 8, wherein said radiation curable material is cured by exposure to ultraviolet radiation.

10. A radiation curable transfer process according to claim 8, wherein said radiation curable material is cured by exposure to ultraviolet radiation having a wavelength in the range of 200–400 nm.

11. A radiation curable transfer process according to claim 1, wherein said radiation curable material is cured by exposure to ultraviolet radiation.

12. A radiation curable transfer process according to claim 1, wherein said radiation curable material is cured by exposure to ultraviolet radiation having a wavelength in the range of 200–400 nm.

13. A radiation curable transfer process according to claim 1, wherein said radiation curable material contains a photoinitiator.

14. A radiation curable transfer process according to claim 1, wherein said image and said radiation curable material are applied to said heat transferable receiver sheet by a digital printer, and wherein said image and said radiation curable material are both applied to said heat transferable receiver sheet prior to removing said heat transferable receiver sheet from said digital printer.

15. A radiation curable transfer process according to claim 14, wherein said radiation curable material is cured by exposure to ultraviolet radiation.

16. A radiation curable transfer process according to claim 14, wherein said radiation curable material is cured by exposure to ultraviolet radiation having a wavelength in the range of 200–400 nm.

* * * * *